United States Patent [19]

Ozer et al.

[11] Patent Number: 4,757,645

[45] Date of Patent: Jul. 19, 1988

[54] CUTTING TOOL AND METHOD OF MAKING SAME

[75] Inventors: Theodore Ozer, Wallingford; Brian Behringer, Norwood, both of Pa.

[73] Assignee: The Boeing Company, Seattle, Wash.

[21] Appl. No.: 429,389

[22] Filed: Sep. 30, 1982

[51] Int. Cl.[4] ..... B24D 7/18

[52] U.S. Cl. ..... 51/206 R; 51/209 R

[58] Field of Search ..... 51/206, 207, 209 R

[56] References Cited

U.S. PATENT DOCUMENTS 4,083,351 4/1978 Greenspan ..... 51/206 P 4,338,748 7/1982 Elbel ..... 51/206 R

*Primary Examiner*—Frederick R. Schmidt

*Assistant Examiner*—Robert A. Rose

*Attorney, Agent, or Firm*—Jones, Tullar & Cooper

[57] ABSTRACT

A cutting tool having grit particles coated onto its outer surface, most of which include a substantially flat outer surface defining at least one cutting edge. The tool has two surfaces which intersect, and the grit particles are adhered to each surface and to the intersection of the surfaces. The grit particles at the intersection of the surfaces have a further substantially flat outer surface defining at least one cutting edge, with the further substantially flat outer surface being inclined relative to the substantially flat outer surfaces on each of the other two surfaces.

11 Claims, 1 Drawing Sheet

CUTTING TOOL AND METHOD OF MAKING SAME

CROSS-REFERENCE TO OTHER APPLICATIONS

This application is the third in a series of commonly assigned applications dealing with the cutting of composite material. The other applications are: application Ser. No. 166,868, by T. Ozer et al now U.S. Pat. No. 4,338,050; and application Ser. No. 192,572, by A. Yankovoy et al now U.S. Pat. No. 4,352,610.

BACKGROUND OF THE INVENTION

1. Field of the Invention

The present invention relates generally to the field of cutting tools, and in particular to a cutting tool for cutting composite material, such as composite honeycomb core material. The honeycomb core material can be of the type comprising aramid fiber with a phenolic resin or fiberglass fibers with phenolic resin.

Honeycomb core is generally made from a series of hexagonal cells, nested together to form panels similar in appearance to a cross-sectional slice of a beehive. A basic characteristic of honeycomb core is that it posseses a high strength-to-weight ratio in the axial direction of the cell structure and a low strength in the transverse direction of the cell structure.

2. Prior Art

In the past it has been difficult to quickly and accurately machine irregular shapes, such as for example interior cut-outs, pockets, holes or bevels, in, for example, composite honeycomb core material. The noted irregular shapes requires any one or more of the following types of cutting: pocket milling, plunge cutting, and bevel cutting. Pocket milling refers to the removal of material in a plane such that a cavity, hollowed out space, or cornered step is created. Plunge cutting refers to creating a hole in the material by driving the cutter tool in a downward motion into, but not necessarily through the material. Finally, bevel cutting refers to a type of cutting whereby two relatively parallel surfaces are connected by an inclined or angular surface.

At the present time, the production of some irregular shapes is done by tedious hand sanding techniques. While the results can be quite satisfactory, the time and costs involved are simply prohibitive.

Experience has shown that the material comprising composite honeycomb core; such as for example aramid fiber or fiberglass mixed with a phenolic resin, tends to deflect, bend or tear before being cut by the shearing action of the cutting edge of a conventional milling cutter. The deflecting, bending or tearing is a result of the low strength of the honeycomb core in the transverse direction of the cell structure and the high elasticity and shear resistance of the materials in composite honeycomb core.

Attempts to produce the noted irregular shapes by using a milling machine equipped with a valve stem cutter were unsuccessful. Valve stem cutters, which are used for cutting thin, small slices of material from the top surface of honeycomb core, do not possess the design characteristics required for pocket milling, plunge cutting or bevel cutting and are therefore limited in the types of irregular shapes that can be produced.

A search of the market for a commercially available cutting tool for machining irregular shapes and capable of producing relatively burr-free surfaces, i.e., a surface where the burr height is less than 0.020 inches determined that none were available.

Since a tool was not available on the market which would achieve the surface finish having the standard burr height noted above, it was decided to design a tool specifically for the purpose.

OBJECTS AND SUMMARY OF THE INVENTION

It is an object of the present invention to provide an optimized tool for cutting irregular shapes in composite material, and in particular, composite honeycomb core material.

A related object of the present invention is to provide a tool for pocket milling, plunge cutting and bevel cutting of composite material, and in particular, composite honeycomb core material, such that the cut surfaces are relatively free of undesirable burring.

A further object of the present invention is to provide a method of manufacturing a tool which will cut composite material, and in particular, composite honeycomb core material, cleanly, i.e., such that burring on the cut surfaces of the composite material is minimized.

From our experience with cutting of composite honeycomb core material, it was determined that, because of the low strength in the transverse direction of the cell structure of the composite honeycomb core material, a tool with a multiplicity of cutting edges would be desirable for machining relatively burr-free surfaces. A cylindrical tool with a coarse grit material on the outer circumference and the bottom face thereof was chosen. Generally, the tool has a body serving as a substrate, on the outer surface of which discrete particles are secured. The tool is subjected to grinding and, ideally, each particle is ground to include a substantially flat exposed surface defining a cutting edge. The particles are randomly applied to the substrate outer surface and cover it substantially completely. During grinding, the outer surface of the substrate is retained intact and only the particles are ground, so that while the particles are randomly applied, the ground surfaces and their corresponding cutting edges are oriented to lie in a similar circumferential plane and include a cutting edge, which is represented by the leading edge of the ground surface, when viewed in the direction of rotation of the circumferential plane.

The individual particles preferably comprise hard carbide grit particles similar to those used in abrading tools. Dimensionally, the grit particles will average 0.080 inches as a maximum diameter. The grit particles are preferably secured to the substrate body by brazing, and ground thereafter. The grit particles are ground to remove the sharp pointed edges inherent to grit particles, which tear materials such as composite honeycomb core materials, thereby producing minute flat cutting surfaces on the grit particles which cut or slice the composite material.

According to one embodiment of the invention, the tool comprises a generally cylindrical body on the outer and bottom surfaces of which a layer of carbide grit particles is deposited. The tool with the carbide grit particle coating is subjected to grinding to produce a cutting surface on preferably each grit piece. The resulting cutting surfaces will lie in a single circumferential plane, and, preferably, will not overlap. In addition, the grit located at the intersection of the outer and bottom surfaces are ground to include an additional cutting surface which is inclined at an angle to the other cutting surface. The grit particles located at the noted intersection is ground in such a manner to create the inclined cutting surface, which is preferably at an angle of approximately 45° to the two intersecting surfaces. The grinding of the grit particles located at the intersection of the outer and bottom surfaces is desirable to remove the sharp pointed edge which develops when the outer and bottom surfaces, which are at approximately 90° to one another, are ground.

DESCRIPTION OF THE PREFERRED EMBODIMENT

Figure 1:
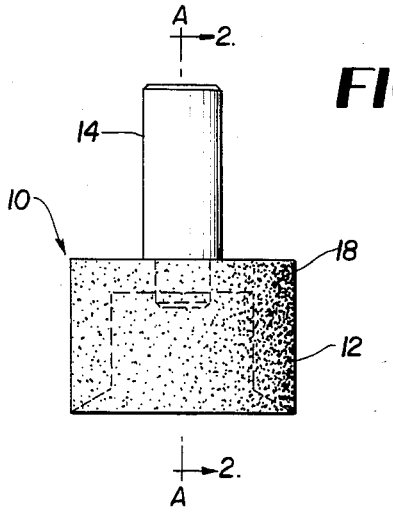
FIG. 1 is an elevational view of the tool according to the present invention.
Figure 2:
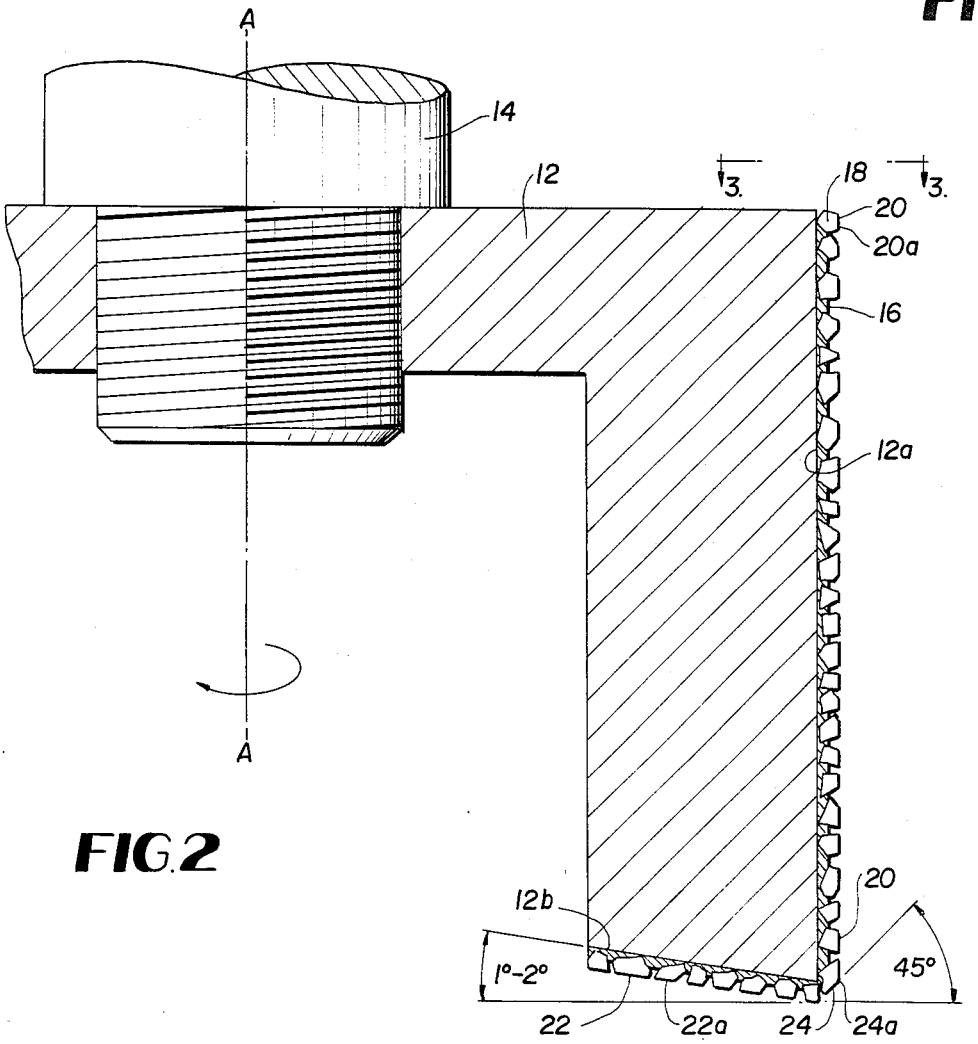
FIG. 2 is a cross-sectional view of the tool taken along line 2—2 of FIG. 1.

The preferred embodiment is shown as tool 10 in FIG. 1. The tool 10 consists basically of a cutter body 12 of cylindrical configuration attached to a shank 14. The shank 14 may be made integral with the cylindrical body 12, or it may be threadedly engaged, as shown in FIG. 2. The cutter body is preferably made from a low alloy steel and the outer surface 12*a* and bottom surface 12*b* serve as substrates on which a grit coat is applied.

The surfaces 12*a* and 12*b*, and their intersection, are first coated with a copper or nickel oxide paste 16. Next, extremely coarse tungsten carbide grit particles 18 are sprinkled on both surfaces 12*a* and 12*b*, and their intersection. After these surfaces and the intersection are sprinkled with the carbide grit particles, the tool is placed in an oven where the grit particles are furnace brazed, in a known manner as disclosed, for example in U.S. Pat. No. 3,918,217, to the surfaces 12*a* and 12*b* and to the intersection.

The carbide grit particles 18 are then ground with, for example, a diamond wheel to form the surfaces 20, 22 and 24, shown in FIG. 2. The surface 24 is a chamfer, inclined, preferably, at 45° to the horizontal. The corner grit piece which defines the chamfered surface 24, also defines a surface 20. All of the surfaces 20, 22 and 24, terminate in cutting edges 20*a*, 22*a* and 24*a*, which are the edges which confront the workpiece in the direction of rotation of the tool, indicated by the clockwise directed arrow above axis A—A shown in FIG. 2.

As a result of the grinding operation, the ground surfaces 20 of each grit particle 18 and corresponding cutting edges 20*a*, lie in a common cylindrical plane. The ground surfaces 22 and corresponding cutting edges 22*a* lie in a common circular plane, while the ground surfaces 24 and corresponding cutting edges 24*a* lie in a common cylindrical plane which intersects the plane of the surfaces 20 at a 45° angle. The grinding to produce surface 24 is desirable because when surfaces 20 and 22 are ground, a sharp pointed edge is developed at the intersection of the two planes, which, if left unground, would tear, rather than cut, the composite honeycomb core material. The surface 12*b* is inclined relative to the horizontal by, preferably, 1°–2°. This inclination is desirable for providing clearance for the cutting of the chamfer, surface 24.

In FIG. 2, the individual grit particles along surfaces 12*a* and 12*b* are shown at relatively equally spaced intervals. This illustration was chosen for ease of understanding since the sprinkling process of applying the grit particles to the surfaces is not so precise, nor need it be. Also, it would be desirable to have, for example, all of the cutting edges 20*a* extend along a true vertical plane and in any given vertical plane to be arranged end-to-end to form thereby a continuous cutting edge extending the full length of the tool surface. Again, the sprinkling process according to which the grit particles are oriented on their respective surfaces is not so precise, nor need it be. It is sufficient, when considering the grit particles arranged on the entire circumference of the surface 12*a*, that the effect of a continuous cutting edge is substantially achieved, i.e., if all of the cutting edges 20*a*, whether lying along a true vertical or skewed thereto, arranged about the circumference defined by the surface 12*a* were projected into a single radial plane, then a substantially continuous cutting edge would result. This is not to suggest that the surface 12*a* only has sufficient grit particles about its circumference to form a single vertical row, but that when considered in toto, there are sufficient grit particles about the circumference of surface 12*a* to substantially complete a full row.

On surface 12*b*, the grit particles 18 are arranged about a circular plane and not a circumferential plane as on surface 12*a*. Nevertheless, what has been stated for the grit particles on surface 12*a* applied to the grit particles on surface 12*b*. The exact location of the individual grit particles is not so important. It is sufficient, when considering the grit particles arranged on the entire surface 12*b*, that the effect of a continuous cutting edge is substantially achieved.

Figure 3:
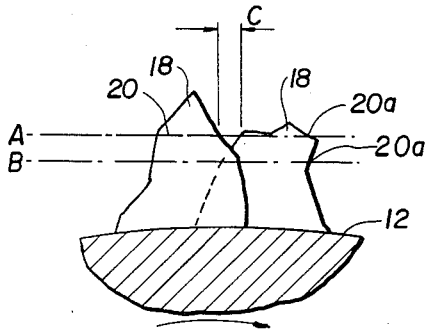
FIG. 3 is a partial top view at the outer longitudinal surface when viewed from line 3—3 of FIG. 2, illustrating the relative circumferential location of two grit particles.

It is desirable that each ground grit particle on surface 12*a* participate in the cutting operation. It is advantageous, therefore, to provide a sufficient clearance c between the cutting edges 20*a* of two adjacent circumferentially spaced grit particles. See FIG. 3, wherein two such particles are depicted. If, during grinding, the grit particles are ground down to surface 20 at plane A, then each surface 20 exhibits an exposed cutting edge 20*a* which will participate in the cutting operation. If, on the other hand, the grit particles are ground down to surface 20 at plane B, only the cutting edge 20*a* of the leading grit particle participates in the cutting operation since clearance c is non-existant. To insure that grinding does not proceed down to plane B, the tool is periodically examined microscopically during the grinding process.

Each of the ground grit particles on surface 12*b* will inherently participate in the cutting operation because of the relative orientation of the surface 12*b* and the surface to be cut, i.e., they are substantially parallel.

The ground grit particles at the intersection of surfaces 12*a* and 12*b* are circumferentially oriented so that they are ground to include the clearance c. In producing the cutting surface 24, it is preferred that a grinding angle of 45° relative to surface 20 be used. This reduces, in a single grinding process, the previously noted sharp pointed edge which develops when surfaces 20 and 22 are ground, and produces instead a substantial cutting surface at the chamfer.

Since not every grit particle will receive a ground surface, it is concluded that a substantial number have received a ground surface if the tool can cut a burr free surface in a sample honeycomb core material. As noted previously, a burr free surface is defined as one which produces burrs with a maximum height of 0.020 inches. Grinding and microscopic monitoring continue until a sample can be cut to achieve the noted standard. After several tools have been ground, to the point that the noted surface standard is met, the tool grinder should be able to establish a standard amount of grinding that is necessary to meet the noted surface standard from visual inspection so that tools ground thereafter need not be tested by cutting a material sample.

A comparative test has been conducted on NOMEX core material with a tool according to the present invention and a tool not embodying the present invention, and the material cut with the tool according to the present invention consistently met the surface standard noted above.

What is claimed is:

1. A rotary cutting tool, comprising:

a substrate body defining an axis of rotation and two intersecting outer surfaces; and a plurality of grit particles adhered to both surfaces and at approximately the intersection of both surfaces, wherein:

(i) a substantial number of grit particles along both surfaces and at approximately the intersection of both surfaces include a substantially flat outer surface defining at least one cutting edge; and (ii) the substantial number of grit particles at approximately the intersection of both surfaces include a further substantially flat outer surface defining at least one additional cutting edge, said further substantially flat outer surface being inclined relative to said axis.

2. The rotary cutting tool as defined in claim 1, wherein the inclination is approximately 45°.

3. The rotary cutting tool as defined in claim 1, wherein the grit particles have an average maximum diameter of 0.080 inches.

4. A tool for cutting composite material, such as honeycomb core materal, comprising:

a generally cylindrical body defining an axis of symmetry, and having a longitudinally extending surface, and a generally transversely extending surface relative to said axis and intersecting said longitudinally extending surface; and a plurality of grit particles adhered to both surfaces and at approximately the intersection of both surfaces, wherein:

(i) a substantial number of grit particles along both surfaces and at approximately the intersection of both surfaces include a substantially flat outer surface defining at least one cutting edge; and (ii) the substantial number of grit particles at approximately the intersection of both surfaces include a further substantially flat outer surface defining at least one additional cutting edge, said further substantially flat outer surface being inclined relative to said axis.

5. The tool as defined in claim 4, wherein the inclination is approximately 45°.

6. The tool as defined in claim 4, wherein said generally transversely extending surface is inclined relative to said longitudinally extending surface.

7. The tool as defined in claim 6, wherein the inclination of said generally transversely extending surface relative to the said longitudinally extending surface is approximately 1°–2°.

8. The tool as defined in claim 4, wherein the inclination of said further substantially flat outer surface of said axis is approximately 45°, and wherein said generally transversely extending surface is inclined to said longitudinally extending surface by approximately 1°–2°.

9. The tool as defined in claim 4, wherein the grit particles have an average maximum diameter of 0.080 inches.

10. The rotary cutting tool as defined in claim 1, wherein one of the intersecting outer surfaces is cylindrical with respect to the axis of rotation and the cutting edges defined by the substantially flat outer surface of adjacent grit particles on the cylindrical outer surface define a clearance between them.

11. The tool as defined in claim 4, wherein the cutting edges defined by the substantially flat outer surface of adjacent grit particles on the longitudinally extending surface define a clearance between them.

* * * * *